United States Patent [19]

Blocker

[11] Patent Number: 4,624,649

[45] Date of Patent: Nov. 25, 1986

[54] TOY FURNITURE DEVICE, AND METHODS OF CONSTRUCTING AND UTILIZING SAME

[76] Inventor: Shirley L. Blocker, 5445 M-140, Eau Claire, Mich. 49111

[21] Appl. No.: 726,881

[22] Filed: Apr. 22, 1985

[51] Int. Cl.[4] ..... A63H 3/52

[52] U.S. Cl. ..... 446/482; 446/479; 190/2; 297/443

[58] Field of Search ..... 446/71, 75, 479, 482; D21/123; 190/2, 8; 211/200; 297/331, 443; 108/12, 124

[56] References Cited

U.S. PATENT DOCUMENTS

| | | | |
|---|---|---|---|
| 102,098 | 4/1870 | DuBois | 190/8 |
| 961,331 | 6/1910 | Young | 446/73 |
| 1,512,725 | 10/1924 | Thomas | 190/2 |
| 2,609,073 | 9/1952 | McLaughlin | 190/2 |

*Primary Examiner*—F. Barry Shay

*Attorney, Agent, or Firm*—Irving M. Weiner; Joseph P. Carrier; Pamela S. Burt

[57] ABSTRACT

A toy furniture device adapted to be converted from a couch arrangement to a fold-down bed arrangement. The device includes a main frame member within which a bed member is pivotably supported, the bed member being pivotably movable between a stored position within the main frame member and a folded-down position wherein it extends substantially perpendicularly from the main frame member. A couch frame cooperates with a couch back portion defined on a bottom panel of the bed to define a couch configuration with a vertical wall therebehind when the bed member is in the stored position. In the folded-down position of the bed member, the couch frame is disposed below the bed member so as to support same and a panel of the main frame member defines a decorative vertical wall.

11 Claims, 5 Drawing Figures

TOY FURNITURE DEVICE, AND METHODS OF CONSTRUCTING AND UTILIZING SAME

BACKGROUND OF THE INVENTION

1. Field of the Invention

The present invention relates generally to a toy furniture device which may be readily converted from one furniture configuration to another. More particularly, the toy furniture device according to the invention provides a toy bed construction which may be readily converted to a toy couch arrangement.

The terminology "toy furniture" as employed herein is intended to connote miniature furniture such as the type frequently used by children when playing with dolls or other similar toys.

2. Description of Relevant Art

Due to the widespread use of miniature toy or doll furniture by children during play, there has developed a desideratum for such furniture which can be handled with ease by even young children, which are imitative of real-life furniture arrangements, and which afford sufficient novelty as to entertain children even after many hours of play. Among other desired features of such toy furniture, it is preferred that the articles of furniture be constructed to be relatively compact while maximizing versatility thereof. In this respect, it is higly desirable that the toy furniture have features which permit the child to selectively manipulate the articles of furniture to arrive at novel and alternative arrangements thereof during play.

Illustrative of toy furniture construction which have been developed are those disclosed in the following United States patents.

U.S. Pat. No. 961,331 discloses a toy handkerchief box which permits conversion thereof between a box-like arrangement wherein the child's handkerchiefs may be stored, and a toy bed configuration wherein flat members defining a head board and foot board for the bed are received within respective end slots of the lower open box portion. Although such construction permits conversion from a handkerchief box configuration to a toy bed configuration, it fails to provide more than one article of furniture with which the child can play.

U.S. Pat. No. 1,453,241 discloses a toy furniture set of interchangeable parts for forming various articles of furniture. Various interchangeable side bars, end bars, chair backs, legs, etc. are provided with slot and tongue couplings to permit construction of a couch, chairs, a table, etc. No provision is made, however, for constructing a full bed simulating a real-life one, or for converting an integral full bed configuration into an integral couch configuration, for example.

U.S. Pat. No. 1,975,305 discloses a toy bed construction including head and foot boards and legs with posts defining a poster bed. The posts on the legs may be folded over the ends of the foot and head boards to facilitate transportation with smaller beds of a set being nested within larger ones. No provision is made for converting the poster bed into an alternative toy furniture configuration.

U.S. Pat. No. 2,546,811 discloses a foldable chair construction for accommodating a child. The chair includes a supporting structure which is bowed until studs are engaged in respective openings. A stretcher is then rotated on the axis of the studs to serve as a tension member, and a seat portion is then lowered into contact with the upper edge of the stretcher. Such construction generally fails to afford a child with any toy or doll furniture which permits selectively converting from one furniture configuration to another.

U.S. Pat. No. Des. 240,547 discloses a toy bed frame including a head board, three horizontal slats, a foot board, and four legs. No provision is made for converting the bed to another article of toy furniture.

None of the foregoing known toy furniture constructions provides a child with a compact and easily manipulated arrangement which permits simple and yet entertaining conversion between desired furniture configurations.

The present invention effectively overcomes the shortcomings of the foregoing known constructions, and at the same time effectively fulfills the aforesaid desideratum.

SUMMARY OF THE INVENTION

The present invention provides a toy furniture device comprising a box-shaped main frame member and a fold-down bed member, the bed member having one end portion thereof pivotably attached to the main frame member to permit pivotal movement of the bed member between a stored position wherein the bed member is disposed substantially within the main frame member, and a folded-down position wherein the bed member extends substantially perpendicularly outwardly from the main frame member.

In a preferred embodiment, the main frame member has an open box configuration, and the bed member has a closed-box configuration including a bottom foundation panel which defines a closed front side of the main frame member when the bed member is pivoted to the stored position thereof. Also included is a couch frame member having a width dimension just greater than that of the bed member, the couch frame member including a lower foundation portion having right and left side arm portions extending upwardly therefrom. The lower foundation portion of the couch frame member is dimensioned to fit below the bottom foundation panel of the bed member to support the bed member in the folded-down position thereof, with the right and left side arm portions disposed adjacent the outside surfaces of the right and left side walls of the bed member, respectively. The bottom foundation panel of the bed member defines a substantially vertical decorative wall surface when the bed member is in the stored position with the main frame member in an upright position, such wall surface having a couch back portion provided thereon which is dimensioned and arranged to operatively cooperate with the couch frame member to define an overall couch configuration when the couch frame member is disposed adjacent the decorative wall surface. At least one couch cushion is removably disposed on the couch foundation portion to define part of the couch configuration.

It is an object of the invention to provide a toy furniture device which can be readily converted from a couch configuration with a decorative vertical wall therebehind to a folded-down bed configuration with another decorative vertical wall therebehind.

A further object of the invention is to provide a toy furniture device which is imitative of real-life furniture configurations, which is compact, and which can be readily manipulated by a small child.

The above and further objects, details and advantages of the present invention will become apparent from the following detailed description of preferred embodiments, when read in conjunction with the accompanying drawings.

DETAILED DESCRIPTION OF PREFERRED EMBODIMENTS

Figure 1:
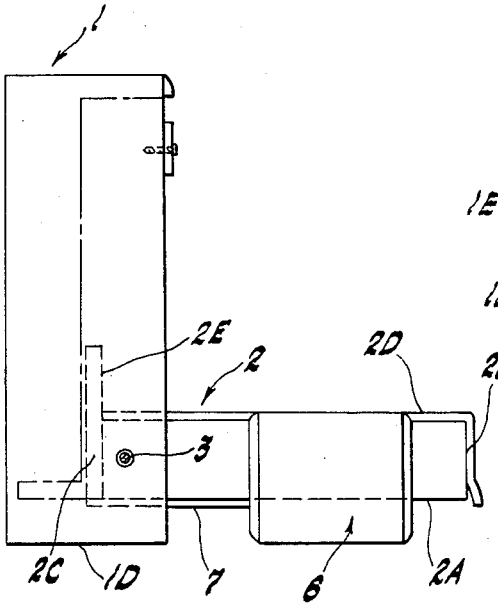
FIG. 1 depicts a side elevational view of a toy furniture device according to a preferred embodiment of the invention, the fold-down bed member of the device being shown in broken line in both the stored and folded-down positions thereof.

With reference to FIG. 1, there is shown a toy furniture device according to a preferred embodiment of the invention. The device includes a box-shaped main frame member 1 having an upper side wall 1A, a left side wall 1B, a right side wall 1C, a lower side wall 1D and a back panel 1E which is joined to each of the side walls to define an open box configuration of main frame 1. The walls and back panel of the main frame 1 are desirably fabricated of a lightweight but sturdy rigid wood or plastic sheet material. Preferably, both the inner and outer surfaces of each of the side walls of main frame 1 have a decorative covering applied thereto, while the inner surface of back panel 1E is decorated with a wall covering material, such as wood panelling, wall paper or the like.

As also shown in FIG. 1, the toy furniture device according to the invention includes a bed member 2 which preferably has a closed-box configuration defined by a bottom foundation panel 2A, right and left side walls, a foot side wall 2B, a head side wall 2C and an upper mattress defining wall 2D. The right and left side walls of bed 2 are respectively pivotably attached at 3 to the right and left side walls of main frame 1, adjacent the head side wall 2C of bed 2, such that the head portion of bed 2 is disposed within main frame 1 in both the stored and the folded-down positions of bed 2 as shown in FIG. 1.

The bed 2 is also desirably fabricated of a lightweight but sturdy wood or plastic sheet material, and preferably has a decorative covering which simulates a conventional bed linen material, such as a bedspread.

Extending upwardly from head side wall 2C of bed 2 is a head board portion 2E which is decoratively covered to simulate a conventional head board. As shown in FIG. 1, when the bed 2 is folded down to define the bed configuration of the toy furniture device according to the invention, the head board 2E extends upwardly within main frame 1, forwardly of the decorated back panel 1E which defines a decorative vertical wall surface rearwardly of bed 2 in its folded-down position. When bed 2 is pivoted upwardly to its stored position within the main frame 2, the head boad portion 2E extends substantially adjacent and parallel to an inner surface of the lower side wall 1D of main frame 1.

Figure 3:
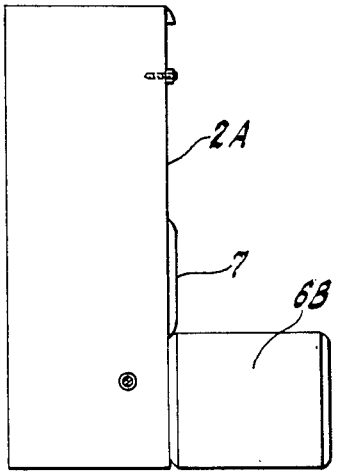
FIG. 3 depicts a side elevational view of the toy furniture device of FIG. 1, with the bed member in the stored position thereof so as to define a couch configuration in conjunction with a couch frame member.

In the stored position of bed 2, i.e., when it is pivoted upwardly so as to be disposed entirely within main frame 1 (shown in dashed line in FIG. 1), the overall configuration of main frame 1 becomes a closed-box one, with the rear or bottom side of foundation panel 2A of bed 2 defining a vertical wall surface as shown most clearly in FIG. 3. To this end, such bottom side of foundation panel 2A is preferably covered with a decorative wall covering material, such as panelling or wall paper, etc. To aid in pivotal movement of bed 2 between its folded down and stored positions, a knob 4 (FIG. 4) is provided on an upper surface portion of bed foundation panel 2A. A pair of latch members 5 are mounted adjacent upper respective ends of the left and right side walls 1B, 1C of main frame 1, such latch members being pivotable to the horizontal position shown in FIG. 4 to retain bed 2 in its stored position within main frame 1. Latch members 5 are pivoted to a vertical orientation thereof when it is desired to pivot bed 2 to its folded-down position.

The toy furniture device according to the present preferred embodiment of the invention further includes a couch frame 6 having a width dimension which is slightly greater than that of bed 2. The couch frame 6 includes a lower foundation portion 6A with right and left side arm portions 6B extending upwardly therefrom. The lower foundation portion 6A of couch frame 6 is dimensionsed to fit closely below the bottom foundation panel 2A of bed 2 so as to support bed 2 in the folded-down position thereof, as shown in FIG. 1. With the bed 2 thus moved to the folded-down position thereof, the side arm portions 6B are disposed adjacent the respective outside surfaces of the right and left side walls of bed 2. A couch cushion 6C is preferably removably disposed on couch foundation portion 6A, and is removed when bed 2 is to be moved to its folded-down position so that the couch foundation portion 6A can directly support the bed 2 thereon.

Figure 4:
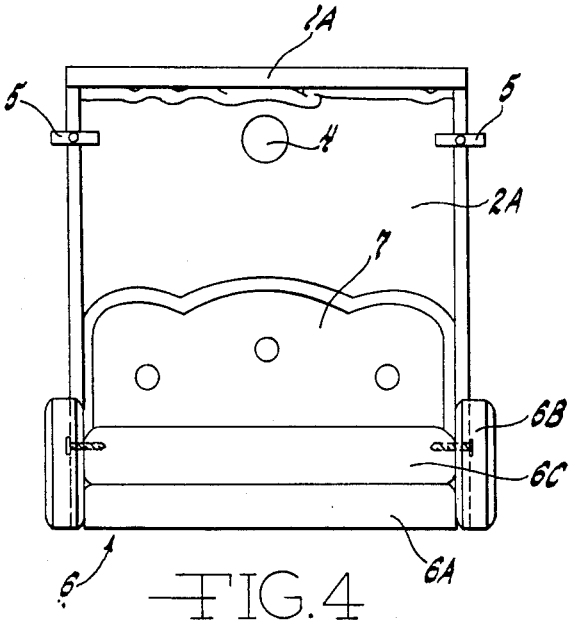
FIG. 4 is a front elevational view of the couch configuration shown in FIG. 3.
Figure 5:
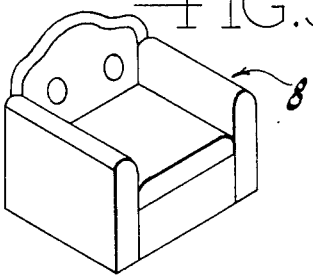
FIG. 5 is a perspective view of an auxiliary matching chair according to the invention.

To complete the couch configuration according to the invention, a couch back portion 7 is integrally provided on the rear or bottom side of bottom foundation panel 2A of bed 2, as shown in FIGS. 3 and 4. The couch back portion 7 is formed with a fabric which matches or coordinates with that with which the couch frame 6 is covered, and may be glued or otherwise affixed to the bottom side of foundation panel 2A. The couch back 7 is dimensioned and arranged to operatively cooperate with couch frame member 6 to define an overall couch configuation when couch frame member 6 is disposed adjacent foundation panel 2A as shown in FIGS. 3 and 4. In such couch configuration, the remainder of foundation panel 2A above couch back 7 defines a decorative vertical wall surface rearwardly of the couch.

Figure 2:
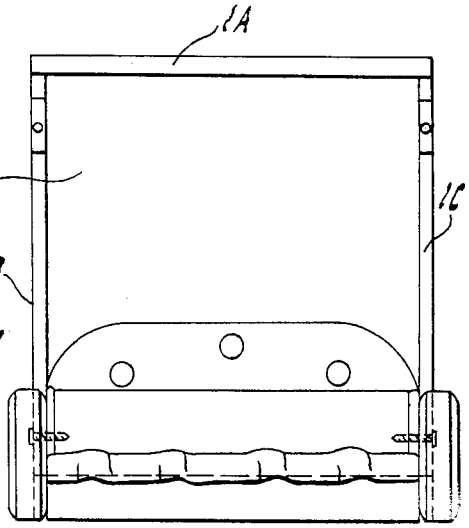
FIG. 2 illustrates a front elevational view of the toy furniture device of FIG. 1, with the bed member in the folded-down position thereof.

By virtue of the foregoing construction, a child may readily convert the device according to the invention from a bed configuration to a couch configuration, and vice versa, as often as is desired. When the device is in the couch configuration thereof as shown in FIGS. 3 and 4, the child has merely to remove couch cushion 6c, move the latches 5 to the vertical positions thereof, and pull on the knob 4 to pivot the bed 2 downwardly to the folded-down position shown in FIGS. 1 and 2, with the couch frame 6 supporting bed 2 as described above. In such bed configuration, the couch frame 6 is preferably moved somewhat away from the main frame 2, by a distance corresponding to the height of couch back portion 7, as shown in FIG. 1.

To change back to the couch configuration of the invention, the child merely reverses the foregoing sequence of operations.

If desired, the toy furniture device according to the invention may also be provided with an auxiliary matching chair 8, covered with a fabric which matches or is coordinated with the fabric of the remaining components of the device. In this respect, it is desirable that the fabric employed for covering bed 2 either matches or coordinates with that employed for covering the couch frame and cushion, and further that the remaining decoratively covered portions of the device be color coordinated with such fabric to thus present an overall aesthetic appearance for the device.

It will be understood from the foregoing that conversion from the couch configuration to the bed configuration of the invention can be readily accomplished by even a young child, and the novelty afforded by such operations can provide the child with many hours of playing enjoyment. Further, the above-described cooperation between the main frame 1, bed 2 and couch frame 6 provides a simplified and compact construction wherein two entirely different furniture configurations can be obtained, each of which will have a decorative vertical wall surface exposed to view.

Exemplary dimensions of the various components according to the foregoing preferred embodiment of the inventions are as follows. The main frame 1 may be approximately 17 inches high, 15 inches wide and 6 inches deep. The bed member 2 may be approximately 14 inches long and $14\frac{3}{4}$ inches wide, to thus fit closely within main frame 1. The couch frame may be approximately 15 inches wide, and the couch back defined on bed foundation panel 2A preferably extends approximately 5 inches above the couch cushion 6C when it is disposed on frame 6 in front of panel 2A as shown in FIG. 4. The bed pivot point 3 (FIG. 1) is approximately $3\frac{3}{8}$ inches from the bottom of main frame 1 and $5\frac{1}{4}$ inches from the rear side thereof. It will be understood, however, that such dimensions are merely exemplary, and may be altered as desired, provided that the interaction between the various component parts as described above is retained.

Although there has been described what is at present considered to be the preferred embodiment of the invention, it will be understood that the present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A toy furniture device, comprising:

a box-shaped main frame member;

a fold-down bed member; and said bed member having one end portion thereof pivotably attached to said main frame member to permit pivotal movement of said bed member between a stored position wherein said bed member is disposed substantially within said main frame member, and a folded-down position wherein said bed member extends substantially perpendicularly outwardly from said main frame member;

said box-shaped main frame member having an open box configuration defined by an upper side wall, a lower side wall, a right side wall, a left side wall and a back panel joined to said sidewalls;

said bed member including a bottom foundation panel which defines a closed front side of said main frame member when said bed member is pivoted to said stored position;

said bed member having a substantially closed-box configuration defined by said bottom foundation panel, a foot side wall, a head side wall, a right side wall, a left side wall and an upper mattress-defining wall;

said right and left side walls of said bed member being respectively pivotably attached to said right and left side walls of said main frame member, adjacent said head side wall of said bed member, such that a head portion of said bed member is disposed within said main frame member in both said stored position and said folded-down position of said bed member;

said head side wall of said bed member being provided with an upwardly extending integral head board portion; and said head board portion extending substantially vertically when said bed member is disposed standing in said folded-down position thereof, and extending substantially adjacent and parallel to an inner surface of said lower side wall of said main frame member when said bed member is disposed in said stored position thereof.

2. A toy furniture device according to claim 1, further comprising:

a couch frame member discrete from said main frame and bed members; and said couch frame member including means comprising a lower foundation portion for coacting with means at said one end to support said foundation panel in substantially level relation when said bed member stands in said folded-down position, said lower foundation portion having right and left side arm portions extending upwardly therefrom.

3. A toy furniture device according to claim 2, wherein:

said lower foundation portion of said couch frame member is dimensioned to fit below said bottom foundation panel of said bed member so as to support said bed member in said folded-down position thereof, with said right and left side arm portions disposed adjacent the outside surfaces of said right and left side walls of said bed member, respectively.

4. A toy furniture device according to claim 2, wherein:

said bottom foundation panel of said bed member defines a substantially vertical decorative wall surface when said bed member is in said stored position with said main frame member in an upright position;

said decorative wall surface has a couch back portion provided thereon; and said couch back portion is dimensioned and arranged so as to operatively cooperate with said couch frame member to define an overall couch configuration when said couch frame member is disposed adjacent said decorative wall surface.

5. A toy furniture device according to claim 4, further comprising:

at least one couch cushion removably disposed on said couch foundation portion.

6. A toy furniture device according to claim 2, wherein:

said walls of said main frame member and said bed member are fabricated of a lightweight wood material.

7. A toy furniture device according to claim 2, wherein:

said bed member and said couch member are decorated with matching or coordinating colored fabric.

8. A toy furniture device according to claim 7, further comprising:

an auxiliary toy chair decorated with said matching or coordinating colored fabric.

9. A toy furniture device according to claim 1, wherein:

an inner surface of said back panel of said main frame member defines a second substantially vertical decorative wall surface when said bed member is disposed in said folded-down position thereof.

10. A toy furniture device according to claim 1, further comprising:

at least one latch member mounted adjacent an upper end of at least one of said right and left side walls of said main frame member, said latch member being movable to a latched position so as to retain said bed member within said main frame member in said stored position of said bed member.

11. A toy furniture device according to claim 1, further comprising:

a knob disposed on an outside upper surface portion of said said bottom foundation panel of said bed member, said knob being adapted to be manually pulled to permit pivotal movement of said bed member from said stored position to said folded-down position.

* * * * *